US007813517B2

(12) United States Patent
Klemenz et al.

(10) Patent No.: US 7,813,517 B2
(45) Date of Patent: Oct. 12, 2010

(54) HEARING AID WITH REDUCED WIND SENSITIVITY AND CORRESPONDING METHOD

(75) Inventors: Harald Klemenz, Fürth (DE); Hartmut Ritter, Neunkirchen am Brand (DE); Dominik Strohmeier, Hersbruck (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1127 days.

(21) Appl. No.: 11/484,164

(22) Filed: Jul. 11, 2006

(65) Prior Publication Data

US 2007/0009127 A1 Jan. 11, 2007

(30) Foreign Application Priority Data

Jul. 11, 2005 (DE) ..... 10 2005 032 292

(51) Int. Cl.
*H04R 25/00* (2006.01)

(52) U.S. Cl. ..... 381/317; 381/320

(58) Field of Classification Search ..... 381/92, 381/94.5, 94.7, 312, 313, 316, 317, 318, 381/320, 321
See application file for complete search history.

(56) References Cited

U.S. PATENT DOCUMENTS

| | | | | |
|---|---|---|---|---|
| 5,058,171 | A * | 10/1991 | Wurzer et al. | 381/94.5 |
| 5,550,925 | A | 8/1996 | Hori et al. | |
| 6,327,370 | B1 * | 12/2001 | Killion et al. | 381/313 |
| 6,741,714 | B2 | 5/2004 | Jensen | |
| 6,882,736 | B2 | 4/2005 | Dickel et al. | |
| 2002/0037088 | A1 | 3/2002 | Dickel et al. | |
| 2004/0161120 | A1 | 8/2004 | Petersen et al. | |

FOREIGN PATENT DOCUMENTS

| | | | |
|---|---|---|---|
| AT | 392 561 | B | 4/1991 |
| DE | 100 45 197 | C1 | 3/2002 |
| EP | 1 196 009 | A2 | 4/2002 |
| EP | 1 448 016 | A1 | 8/2004 |
| EP | 1 519 626 | A2 | 3/2005 |
| WO | WO 03/059010 | A1 | 7/2003 |
| WO | WO 2004/103020 | A1 | 11/2004 |

OTHER PUBLICATIONS

Theodore M. Farabee, Mario J. Casarella, "Spectral Features of Wall Pressure Fluctuations Beneath Turbulent Boundary Layers", Phys. Fluids A 3 (10), Oct. 1991, pp. 2410-2420.

* cited by examiner

*Primary Examiner*—Brian Ensey

(57) ABSTRACT

The wind sensitivity of hearing aids is reduced. The noise level of at least two microphones is measured and to compared with one another. The microphones are controlled according to the comparison result. In one embodiment, the microphone having the lowest noise level is used as an omnidirectional microphone in a wind situation.

18 Claims, 1 Drawing Sheet

HEARING AID WITH REDUCED WIND SENSITIVITY AND CORRESPONDING METHOD

CROSS REFERENCE TO RELATED APPLICATIONS

This application claims priority of German application No. 10 2005 032 292.1 filed Jul. 11, 2005, which is incorporated by reference herein in its entirety.

FIELD OF THE INVENTION

The present invention relates to a hearing aid with a plurality of microphones, a noise detection device for detecting wind noise and for outputting a corresponding detection signal, and a signal processing device for activating the plurality of microphones as a function of the detection signal. The present invention additionally relates to a corresponding method for controlling a plurality of hearing aid microphones.

BACKGROUND OF THE INVENTION

Hearing aids which also permit directional hearing are highly wind-sensitive due essentially to the forward position of the microphones, low-frequency pseudo noise caused by turbulent flows at the head and outer ear (pinna) or at the edge of the outer ear (helix) making itself particularly noticeable. This pseudo noise is only audible in the near field and occurs at the pinna and at the back of the head. As the microphones are now located in the immediate vicinity of the pinna for functional reasons, this pseudo noise is picked up in an amplified manner by the hearing aid, resulting in an unpleasant noise ("rumble").

Until now, wind has been detected using two active microphones in the case of a directional hearing aid, with the device being switched automatically from directional to omnidirectional mode. If necessary, amplification is additionally reduced in the low frequency bands in omnidirectional mode. This does not always achieve an adequate reduction in the unpleasant noise.

A similar hearing aid is disclosed, for example, in publication WO 03/059010 A1. This hearing aid has two microphones possessing different sensitivities to wind noise. The wind noise level of one of the microphones is detected and, on the basis of this signal, it is decided which of the two microphones is to supply the input signal for subsequent signal processing. However, it cannot be ensured that the microphone with the, in principle, lower wind sensitivity also actually supplies a smaller wind noise signal in the specific situation.

In addition, EP 1 196 009 A2 discloses a hearing aid with adaptive matching of the input transducers. For example, when wind is detected, not only the transducers but also e.g. the signal filtering is adapted. It is specifically proposed that the device is switched from directional mode to omnidirectional mode when wind noise is detected.

Moreover, WO 2004/103020 A1 discloses a hearing aid equipped with an additional microphone which is sheltered from wind effects. Accordingly, the wind-sheltered microphone can be used as the input transducer on the event of wind noise detection.

Finally publication US 2002/0037088 A1 discloses a method of reducing wind noise by deactivating one or more microphones.

SUMMARY OF THE INVENTION

The object of the present invention is therefore to further reduce the sensitivity of hearing aids to wind disturbance.

This object is achieved according to the invention by a hearing aid with a microphone device comprising a plurality of microphones, a noise detection device for detecting wind noise and outputting a corresponding detection signal, and a signal processing device for activating the microphone device as a function of the detection signal, whereby a noise level of at least two of the plurality of microphones can be detected by the noise detection device and the at least two noise levels can be compared with one another in the signal processing device and an appropriate activating signal can be output to the microphone device.

There is additionally provided according to the invention a method for controlling a plurality of microphones of a hearing aid by detecting wind noise and outputting a corresponding detection signal and activating the plurality of microphones as a function of said detection signal, a noise level of at least two of the plurality of microphones being detected, the at least two noise levels being compared with one another and the microphones being activated according to the comparison result.

The underlying idea of the invention is to measure the actual noise level cause by wind at a plurality of microphones of the hearing aid and to control the microphones as a function thereof. This means that the wind noise intensity is measured in its actual form at a plurality of hearing aid locations and the hearing aid is controlled accordingly.

The activating signal is preferably a signal for driving the microphones into omnidirectional mode, thereby enabling the signal-to-noise ratio to be increased.

In addition, it is advantageous if the in particular wind-induced noise is continuously detectable by the noise detection device and the microphones can be continuously activated accordingly by the signal processing device, thereby enabling the microphones to be controlled and switched on a situation-dependent basis.

According to a particular embodiment of the hearing aid according to the invention, the microphone with the lowest noise level can be detected by the signal processing device, this microphone can be used for omnidirectional operation and the other microphone(s) can be deactivated. This enables the microphone least affected by the wind to be the only one used for signal processing.

In addition, the signal processing device can have a classifier for selecting the microphone(s) for subsequent signal processing on the basis of the noise levels. This enables the microphones to be selectively switched to the appropriate mode.

BRIEF DESCRIPTION OF THE DRAWINGS

The present invention will now be explained in greater detail with reference to the accompanying drawings in which.

DETAILED DESCRIPTION OF THE INVENTION

The example detailed below constitutes a preferred embodiment of the present invention.

Figure 1:
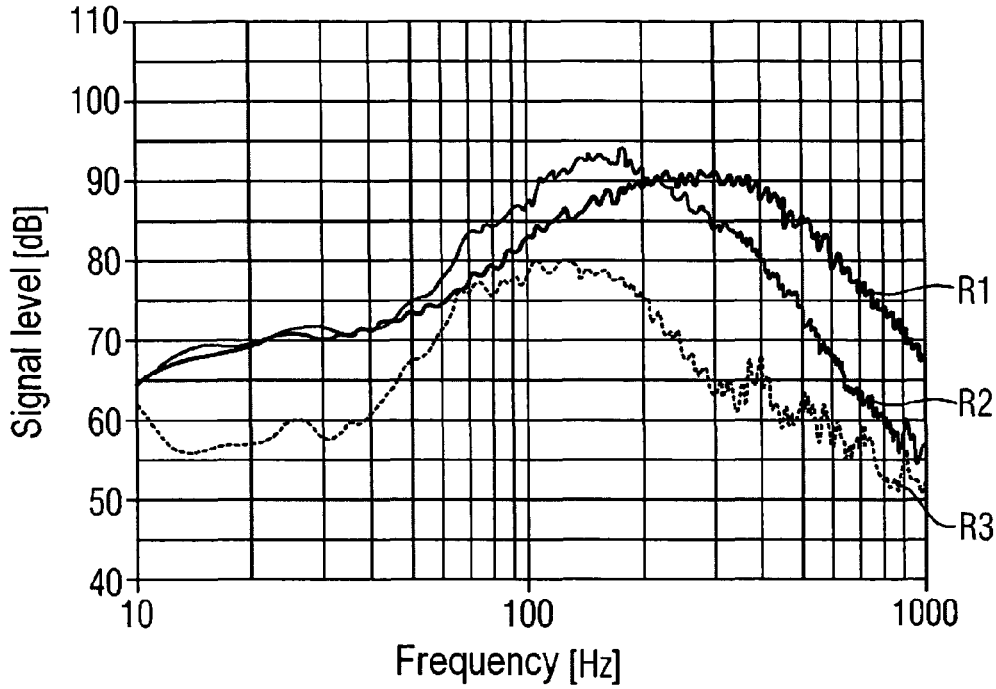
FIG. 1 shows the wind-induced frequency response for three microphones of a hearing aid.

Directional hearing aids have a plurality of microphones which for functional reasons do not have their outlet openings at the same position on the hearing aid. Therefore, when the hearing aid is worn, the outlet openings on the wearer's ear are also not located at the same position on the head or more specifically on the pinna. Consequently, as shown in FIG. 1, the individual microphones exhibit different wind sensitivities depending on the position on the ear and also naturally on the shape of the pinna. In the present example, the microphone array in the hearing aid (two or three microphones) not only detects wind but also simultaneously measures wind noise on a frequency-specific basis by means of internal level meters. According to FIG. 1, there is produced for a first microphone a first noise spectrum R1, for a second microphone a second noise spectrum R2 and for a third microphone a third noise spectrum R3. The level of the third noise spectrum R3 of the third microphone is here lower than the noise levels of the two other microphones in all spectral ranges. A corresponding comparison would therefore produce the result that the third microphone is least wind-affected throughout the spectral range. Accordingly, it should be used as the sole omnidirectional microphone in the current situation.

FIG. 1 also shows that the noise spectrum R2 is higher than the noise spectrum R1 in the mid-frequency range and lower than it in the higher frequency range. If a hearing aid were equipped with these two microphones only, in the current wind situation these two microphones could be switched in such a way that the second microphone is used as an omnidirectional microphone in the lower and mid-frequency range and the first microphone in the higher frequency range. This means that the microphones are activated or switched on a frequency-specific basis for the relevant wind situation.

The level spectra can be compared e.g. using adjustable threshold values. The omnidirectional microphone signal or a combination of microphone signals (e.g. sum of two or three microphone signals) more suited to the wind situation can then be selected using a classifier. This enables the wind-induced pseudo noise to be further reduced adaptively as a function of the wind velocity/turbulent force and position of the microphones on the head. Measurements on the head using a wind setup for wind velocities up to 20 km/h showed that, in addition to the abovementioned measures (automatic switchover from directional to omnidirectional mode and reduction of amplification at lower frequencies), further improvements of up to 15 dB can be achieved by, if necessary, frequency-selective selection of the lower-noise omnidirectional microphone in each case.

Figure 2:
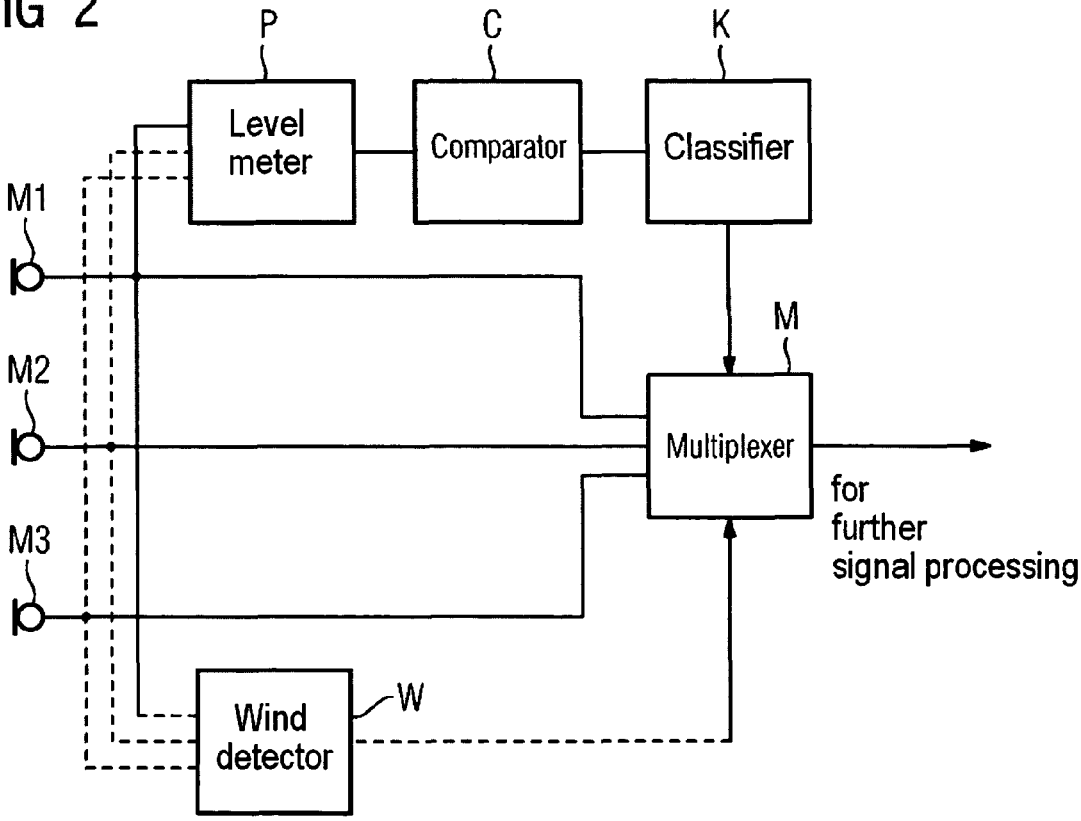
FIG. 2 shows a block diagram of a hearing aid according to the invention.

The basic design of a hearing aid according to the invention is shown in FIG. 2. The hearing aid has three microphones M1, M2 and M3. The noise signals of all three microphones M1, M2 and M3 are measured in a level meter P. A following comparator C compares the level spectra with defined threshold values as required. A following classifier K then decides on the basis of the comparisons which microphone is to be used as input transducer for signal processing in the hearing aid. Under the control of the signal from the classifier K, a multiplexer M through-connects the appropriate signal for omnidirectional mode for further signal processing.

Simultaneously a wind detector W determines whether any wind noise is present at the microphones. Only if wind is detected is the multiplexer M activated and the more suitable microphone is through-connected if necessary on a frequency-specific basis. On the other hand, if no wind is detected, the signals of all the microphones are used for achieving a directional effect. It may also be useful to switch a pure omnidirectional signal, comprising signals from M1 or any combination of M1 and Mn, over to a wind-reduced omnidirectional signal from another microphone M2 or M3.

The invention claimed is:

1. A hearing aid, comprising:

a plurality of microphones;

a noise detection device operatively connected to the microphones for detecting wind noise levels of the microphones; and a signal processing device operatively connected to the noise detection device for comparing the wind noise levels and activating the microphones as a function of the wind noise levels to reduce a wind sensitivity of the hearing aid, wherein the signal processing device comprises a classifier for selecting the microphones for further signal processing based on the wind noise levels.

2. The hearing aid as claimed in claim 1, wherein the microphones are activated by switching the microphones from a directional operation mode to an omnidirectional operation mode.

3. The hearing aid as claimed in claim 1, wherein the wind noise levels are continuously detected and the microphones are continuously activated.

4. The hearing aid as claimed in claim 1, wherein a microphone with a lowest wind noise level is activated for an omnidirectional operation mode and the other microphones are deactivated.

5. A hearing aid, comprising:

a plurality of microphones;

a noise detection device operatively connected to the microphones for detecting wind noise levels of the microphones; and a signal processing device operatively connected to the noise detection device for comparing the wind noise levels and activating the microphones as a function of the wind noise levels to reduce a wind sensitivity of the hearing aid, wherein wind noise level spectrums of the microphones are detected by the noise detection device and a microphone with a lowest noise level spectrum in a spectral range is activated in the spectral range.

6. The hearing aid as claimed in claim 5, wherein the microphones are activated differently in a different spectral ranges based on the wind noise level spectrums in the spectral ranges.

7. The hearing aid as claimed in claim 5, wherein the microphones are activated by switching the microphones from a directional operation mode to an omnidirectional operation mode.

8. The hearing aid as claimed in claim 5, wherein the wind noise levels are continuously detected and the microphones are continuously activated.

9. The hearing aid as claimed in claim 5, wherein a microphone with a lowest wind noise level is activated for an omnidirectional operation mode and the other microphones are deactivated.

10. A method for reducing a wind sensitivity of a hearing aid having a plurality of microphones, comprising:

detecting wind noise levels of the microphones;

comparing the wind noise levels; and activating the microphones as a function of the wind noise levels based on the comparison, wherein the wind noise levels of the microphones are classified and the microphones are activated based on the wind noise levels for a further signal processing.

11. The method as claimed in claim 10, wherein the microphones are activated by switching the microphones from a directional operation mode to an omnidirectional operation mode based on the wind noise levels.

12. The method as claimed in claim 10, wherein the wind noise levels of the microphones are continuously detected and the microphones are continuously activated.

13. The method as claimed in claim 10, wherein a microphone with a lowest noise level is detected and is used for an omnidirectional operation mode and the remaining microphones are deactivated.

14. A method for reducing a wind sensitivity of a hearing aid having a plurality of microphones, comprising:

detecting wind noise levels of the microphones;

comparing the wind noise levels; and activating the microphones as a function of the wind noise levels based on the comparison, wherein wind noise spectrums of the microphones are detected by the noise detection device and a microphone with a lowest noise level spectrum in a spectral range is activated in the spectral range.

15. The hearing aid as claimed in claim 14, wherein the microphones are activated differently in a different spectral ranges based on the wind noise level spectrums in the spectral ranges.

16. The method as claimed in claim 14, wherein the microphones are activated by switching the microphones from a directional operation mode to an omnidirectional operation mode based on the wind noise levels.

17. The method as claimed in claim 14, wherein the wind noise levels of the microphones are continuously detected and the microphones are continuously activated.

18. The method as claimed in claim 14, wherein a microphone with a lowest noise level is detected and is used for an omnidirectional operation mode and the remaining microphones are deactivated.

* * * * *